US010468810B2

(12) United States Patent
Lin

(10) Patent No.: US 10,468,810 B2
(45) Date of Patent: Nov. 5, 2019

(54) CONNECTOR EXPANSION STRUCTURE

(71) Applicant: P-Two Industries Inc., Taoyuan (TW)

(72) Inventor: Shien-Chang Lin, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/164,067

(22) Filed: Oct. 18, 2018

(65) Prior Publication Data

US 2019/0140387 A1 May 9, 2019

(30) Foreign Application Priority Data

Nov. 7, 2017 (TW) ..... 106138695 A

(51) Int. Cl.

| | |
|---|---|
| ***H01R 13/506*** | (2006.01) |
| ***H01R 13/6581*** | (2011.01) |
| ***H01R 13/502*** | (2006.01) |
| ***H01R 12/77*** | (2011.01) |
| ***H01R 13/6591*** | (2011.01) |
| *H01R 12/79* | (2011.01) |
| *H01R 24/60* | (2011.01) |
| *H01R 107/00* | (2006.01) |

(52) U.S. Cl.

CPC ..... *H01R 13/506* (2013.01); *H01R 12/774* (2013.01); *H01R 13/5025* (2013.01); *H01R 13/6581* (2013.01); *H01R 13/6591* (2013.01); *H01R 12/79* (2013.01); *H01R 24/60* (2013.01); *H01R 2107/00* (2013.01)

(58) Field of Classification Search

CPC . H01R 24/60; H01R 13/6581; H01R 13/6594
See application file for complete search history.

(56) References Cited

U.S. PATENT DOCUMENTS

| | | | | |
|---|---|---|---|---|
| 10,218,134 | B2 * | 2/2019 | Tsai | H01R 13/6585 |
| 2019/0067867 | A1 * | 2/2019 | Zhou | H01R 13/5216 |
| 2019/0067879 | A1 * | 2/2019 | Zhao | H01R 13/6585 |

* cited by examiner

*Primary Examiner* — Ross N Gushi

(74) *Attorney, Agent, or Firm* — Muncy, Geissler, Olds & Lowe, P.C.

(57) ABSTRACT

A connector expansion structure includes a connector and a rear plug. The connector includes a base, a sheet-shaped contact part, a shell-shaped member and a plurality of conductive terminals. The sheet-shaped contact part includes a sheet-shaped structure and an extension structure. The shell-shaped member extends in the normal direction of a first end surface, covers the sheet-shaped contact part, and encloses the ring-shaped structure of the base. The conductive terminal and the rear plug are disposed on the extension structure. The rear plug includes conductive terminal tracks for accommodating the conductive terminals. Two sides of the rear plug block are provided with position-limit tracks and the engagement tracks. Wherein the rear plug is slidable on the extension structure.

13 Claims, 8 Drawing Sheets

CONNECTOR EXPANSION STRUCTURE

CROSS-REFERENCE TO RELATED APPLICATION

This application claims the benefit of Taiwan Patent Application No. 106138695, filed on Nov. 7, 2017, in the Taiwan Intellectual Property Office, the disclosure of which is incorporated herein in its entirety by reference.

BACKGROUND OF THE INVENTION

1. Field of the Invention

The present invention relates to a connector, more particularly to a connector expansion structure.

2. Description of the Related Art

An existing connector is inserted into a cable structure through an opening thereof. However, when the cable structure is inserted into the connector, poor transmission contact may occur because the cable structure is pulled or the conductive unit is loose. Furthermore, when a user wants to use the connector in devices with different specifications, the external openings of the devices usually have different contact positions, so the connector must be redesigned according to the positions of the openings, as a result, the manufacturing process cost, the assembly cost and time of the connector are increased.

SUMMARY OF THE INVENTION

In order to solve the above-mentioned problem, the present invention provides a connector expansion structure.

An objective of the present invention is to provide a connector expansion structure including a connector and a rear plug. The connector includes a base, a sheet-shaped contact part, a shell-shaped member, and a plurality of conductive terminals. The base includes a first end surface and a second end surface. The sheet-shaped contact part is disposed through the base and includes a sheet-shaped structure extending in a normal direction of the first end surface, and an extension structure extending in a normal direction of the second end surface. The extension structure includes an extension opening, a plurality of recessed fastening parts disposed on an outer edge of the extension structure, a plurality of engagement member disposed on two sides of the extension opening and extending in the normal direction of the second end surface and having a bent step structure, and a plurality of position-limiting members extending in the normal direction of the second end surface. The shell-shaped member is in a ring-shaped structure for enclosing the base, and extends in the normal direction of the first end surface to cover the sheet-shaped structure. The shell-shaped member includes a plurality of guide plates extending in the normal direction of the second end surface. The plurality of conductive terminals are disposed on the sheet-shaped contact part, and extend in the normal direction of the first end surface along the sheet-shaped structure and through the base, and inserted through the extension opening in the normal direction of the second end surface. The rear plug is disposed on the extension structure, and includes a plurality of conductive terminal tracks configured to accommodate the plurality of conductive terminals, a plurality of position-limit tracks corresponding to the plurality of position-limiting members, a plurality of engagement tracks corresponding to the plurality of engagement members, and a plurality of guide plate tracks corresponding to the guide plate are disposed on two sides of the rear plug. The rear plug is slidable on the extension structure.

Preferably, the position-limiting members and the engagement members are disposed on two sides of the extension structure with the same configurations.

Preferably, the position-limiting members and the engagement members are disposed on the two sides of the extension structure with opposite configurations.

Preferably, each of engagement members includes a sloping engagement structure facing the normal direction of the second end surface, and a flat engagement structure facing the normal direction of the first end surface, and a cable unit is inserted into the engagement members along the sloping engagement structures and abutted against the flat engagement structures.

Preferably, each of position-limiting members has two bar-shaped structures arranged side-by-side, and the two bar-shaped structures includes sloping position-limiting structures facing the normal direction of the second end surface, and flat position-limiting structures facing the normal direction of the first end surface, and the position-limiting members are inserted into the position-limit tracks along the sloping position-limiting structures and abutted against the flat position-limiting structures.

Preferably, the rear plug is supported and abutted against by the position-limiting members and is slidable on the extension structure.

Preferably, the conductive terminal includes a clamped part in an arc and bent sharply, and when the rear plug is moved in the normal direction of the first end surface, the conductive terminal tracks applies a clamping force on the conductive terminals through the clamped parts.

Preferably, the connector expansion structure further includes a fastening structure enclosing the connector, and the fastening structure includes fastening parts disposed on two sides thereof, respectively, and each of the fastening parts includes a hole.

Preferably, the connector expansion structure further includes a position-limiting block enclosing of the connector and configured to fix the connector expansion structure on a transmission interface.

Preferably, each of the plurality of guide plates includes a front buckling part and a rear buckling part protruded relative to a horizontal direction thereof, and the front buckling parts are configured to fasten with the recessed fastening parts.

Preferably, the rear plug is slidable between the rear buckling part and the extension structure.

Preferably, each of the guide plate tracks includes a metal buckling part, and the metal buckling parts are configured to fasten with the recessed fastening parts.

Preferably, when the cable unit is not inserted into the connector expansion structure but the rear plug is slid to abut against the front buckling parts, the engagement member is clamped by the engagement track to contact the rear plug, so as to block the cable unit from being inserted into the connector expansion structure.

According to above contents, the connector expansion structure of the present invention has the following advantages.

First, in the connector expansion structure of the present invention, the conductive terminal extends out of the base, and the clamped part of each conductive terminal is in cooperation with the conductive terminal track of the rear plug. The rear plug can be moved to front and rear positioning locations, so as to apply clamping force on the conductive terminals, thereby improving the stability of the conductive terminals and the inserted cable structure.

Secondly, in the connector expansion structure of the present invention, the fastening structure is disposed on outside of the connector expansion structure to enclose the position-limiting block of the connector. In this way, the connector is applicable to different signal transmission interface by changing forms of the fastening structure and the position-limiting block, and without frequent replacement upon usage condition, thereby reducing replacement of the component, and increasing the applicability of the connector.

Thirdly, the guide plate of the shell-shaped member can guide the movement of the rear plug and can shield the high frequency signal transmitted through the rear plug, thereby improving quality of signal transmission.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
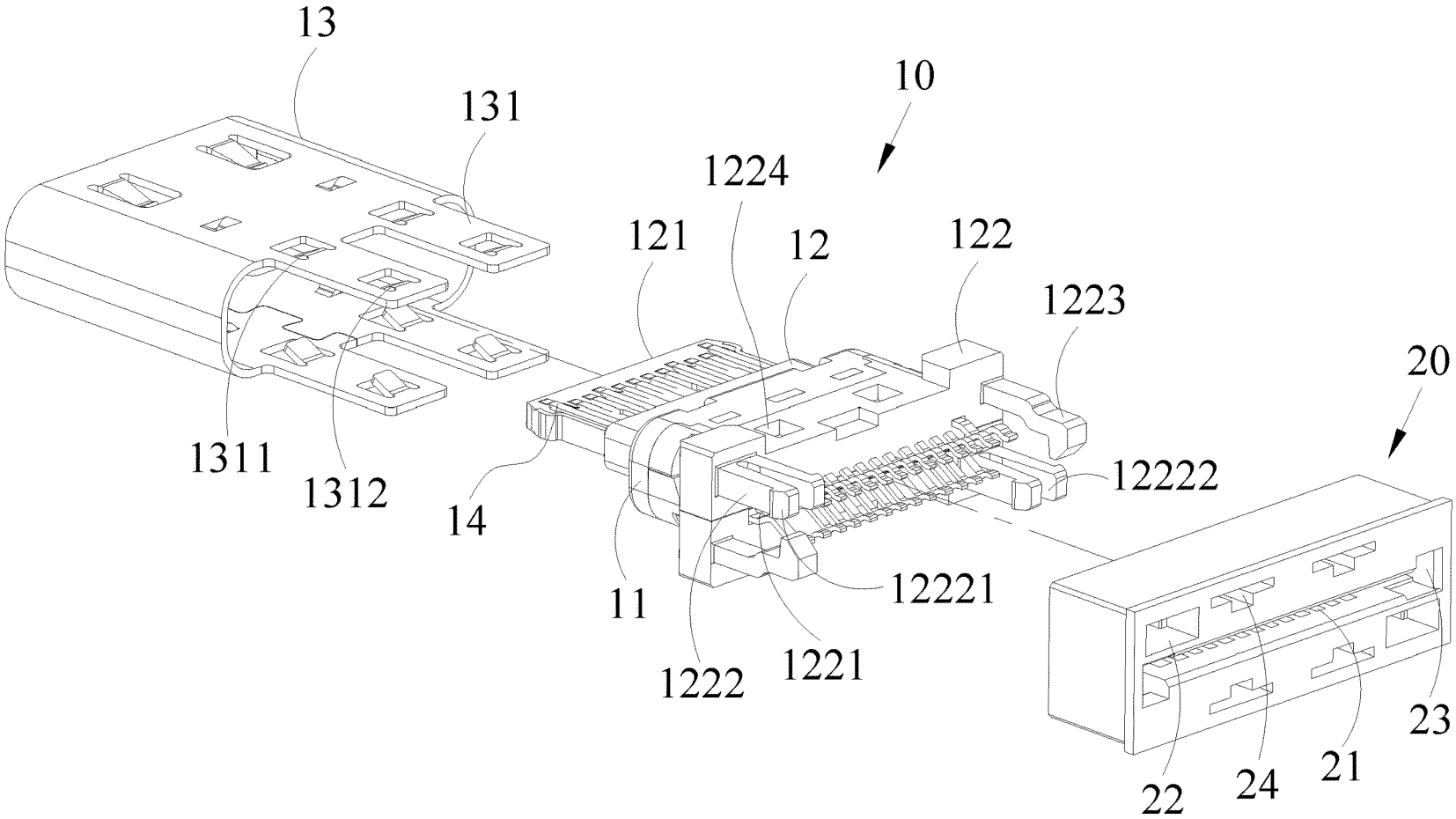
FIG. 1 is an exploded view of a connector expansion structure of the present invention.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any or all combinations of one or more of the associated listed items.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "include/comprise" and variations such as "includes/comprises" or "including/comprising", will be understood to imply the inclusion of stated elements but not the exclusion of any other elements.

Figure 2:
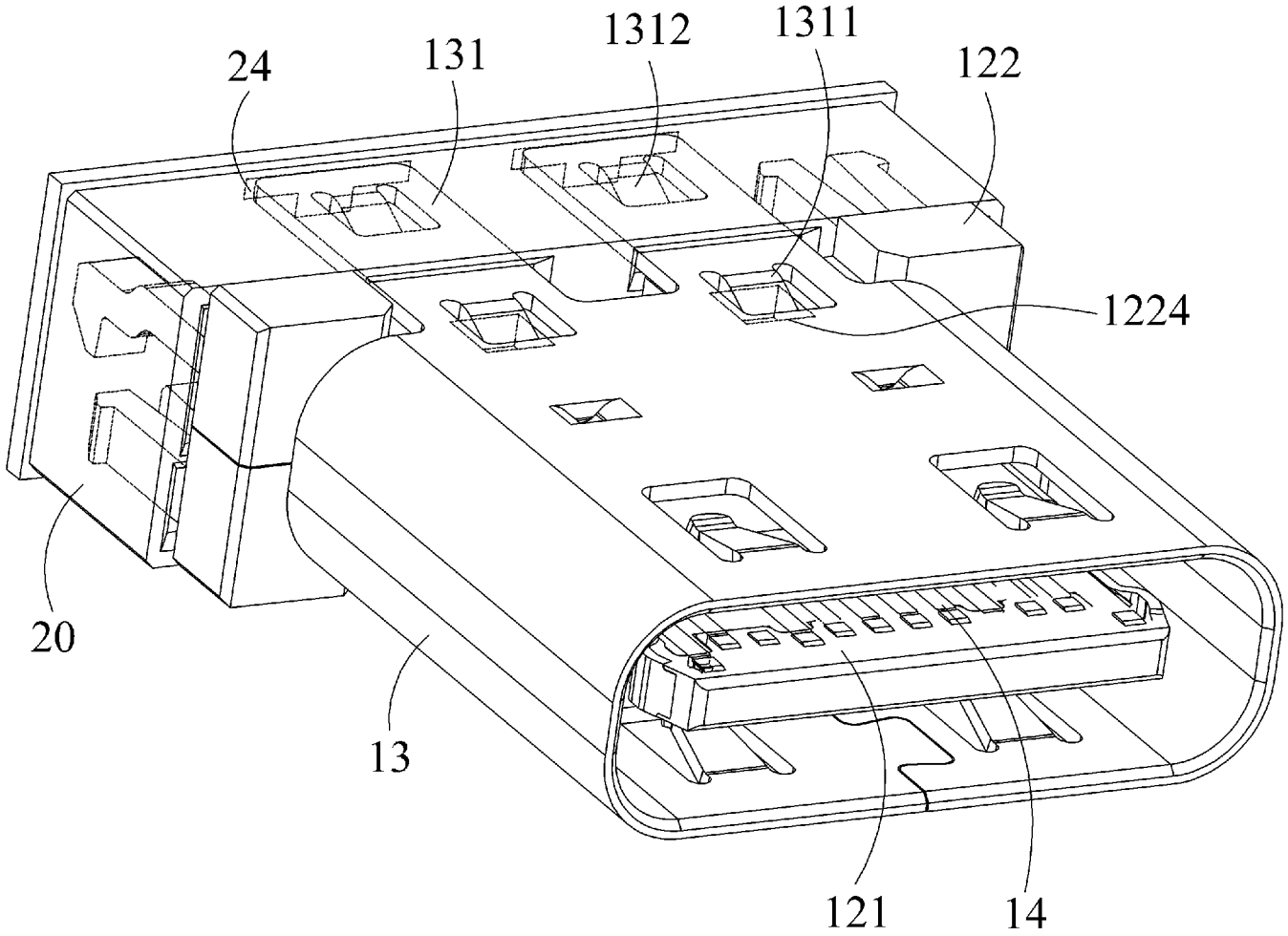
FIG. 2 is an assembly view of a connector expansion structure of the present invention.

Please refer to FIGS. 1 and 2, which show an exploded view of a connector expansion structure of the present invention and an assembly view of a connector expansion structure of the present invention. As shown in FIGS. 1 and 2, the connector expansion structure mainly includes a connector 10, a base 11, a sheet-shaped contact part 12, a shell-shaped member 13, the plurality of conductive terminals 14, and a rear plug 20.

The base 11 includes a first end surface facing a front end thereof, and a second end surface facing rear end thereof. The sheet-shaped contact part 12 is disposed through the base 11 and includes a sheet-shaped structure 121 extending in the normal direction of the first end surface, and an extension structure 122 extending in the normal direction of the second end surface. The extension structure 122 includes extension opening 1221, engagement members 1223 disposed on two sides thereof and extending in the normal direction of the second end surface, and at least one position-limiting members 1222 extending from the extension opening 1221 in the normal direction of the second end surface. Wherein each of the position-limiting members 1222 has two bar-shaped structures arranged side-by-side, and the two bar-shaped structures includes a sloping position-limiting structure 12221 facing the normal direction of the second end surface, and a flat position-limiting structure 12222 facing the normal direction of the first end surface. Each of the engagement members 1223 has a bent step structure.

The shell-shaped member 13 is configured to cover and surround the ring-shaped structure of the base 11, and attach the outer periphery of the base 11, and forwardly extend from the base 11 in the normal direction of the first end surface, so as to form a ring-shaped shape for shielding the sheet-shaped structure 121. The shell-shaped member 13 also includes a plurality of plurality of guide plates 131 extending in the normal direction of the second end surface, and each guide plate 131 includes a front buckling part 1311 and a rear buckling part 1312 protruded relative to the horizontal direction of the guide plate. Please refer to FIG. 2. The front buckling parts 1311 and the recessed fastening parts 1224 are fastened to each other to fix the shell-shaped member 13 and the sheet-shaped contact part 12.

Each of the conductive terminals 14 is disposed on the sheet-shaped contact part 12, attaches to the sheet-shaped structure 121, and extends from the sheet-shaped structure 121 in the normal direction of the first end surface through the base 11. Each of the conductive terminals 14 is also inserted through the sheet-shaped contact part 12 and the extension structure 122, and is inserted out of the extension opening 1221 to expose out of the extension opening 1221. The extension length of the conductive terminal 14 can be beyond the extension opening 1221, or aligned to a vertical section vertical the extension opening 1221, or, not beyond the vertical section of the extension opening 1221.

The rear plug 20 includes conductive terminal tracks 21, position-limit tracks 22 and engagement tracks 23. As shown in FIG. 2, when the rear plug 20 abuts against the extension structure 122, the guide plates 131 can be accommodated in the guide plate tracks 24. The position-limiting members 1222 can be accommodated in the position-limit tracks 22, respectively, and the engagement members 1223 can be accommodated in the engagement tracks 23, respectively, and the conductive terminals 14 can be accommodated in the conductive terminal tracks 21. It should be noted that, at this time, the rear buckling parts 1312 of the guide plates 131 is also accommodated in the guide plate tracks 24.

The height position of the rear plug 20 can be fixed by the position-limiting members 1222, so that the rear plug 20 can be supported by the position-limiting members 1222 to slide back and forth relative to the extension structure 122.

The content described with reference to FIGS. 1 and 2 is merely for an embodiment of the invention. As shown in FIGS. 1 and 2, the position-limiting members 1222 and the engagement members 1223 are arranged on left and right sides of the sheet-shaped contact part 12 with opposite configurations. For example, when one of the position-limiting members 1222 disposed on the left side of the sheet-shaped contact part 12 is below one of the engagement members 1223, the other one of the position-limiting members 1222 disposed on the right side of the sheet-shaped contact part 12 is disposed above the other one of the engagement members 1223. However, the present invention is not limited to this example; and, in an embodiment, the position-limiting members 1222 and the engagement members 1223 can be arranged at left and right sides of the sheet-shaped contact part 12 with the same configurations. That is, when one of the position-limiting members 1222 disposed on the left side of the sheet-shaped contact part 12 is below one of the engagement members 1223, and the other one of the position-limiting members 1222 disposed on the right side of the sheet-shaped contact part 12 is also below the other one of the engagement members 1223.

Figure 3:
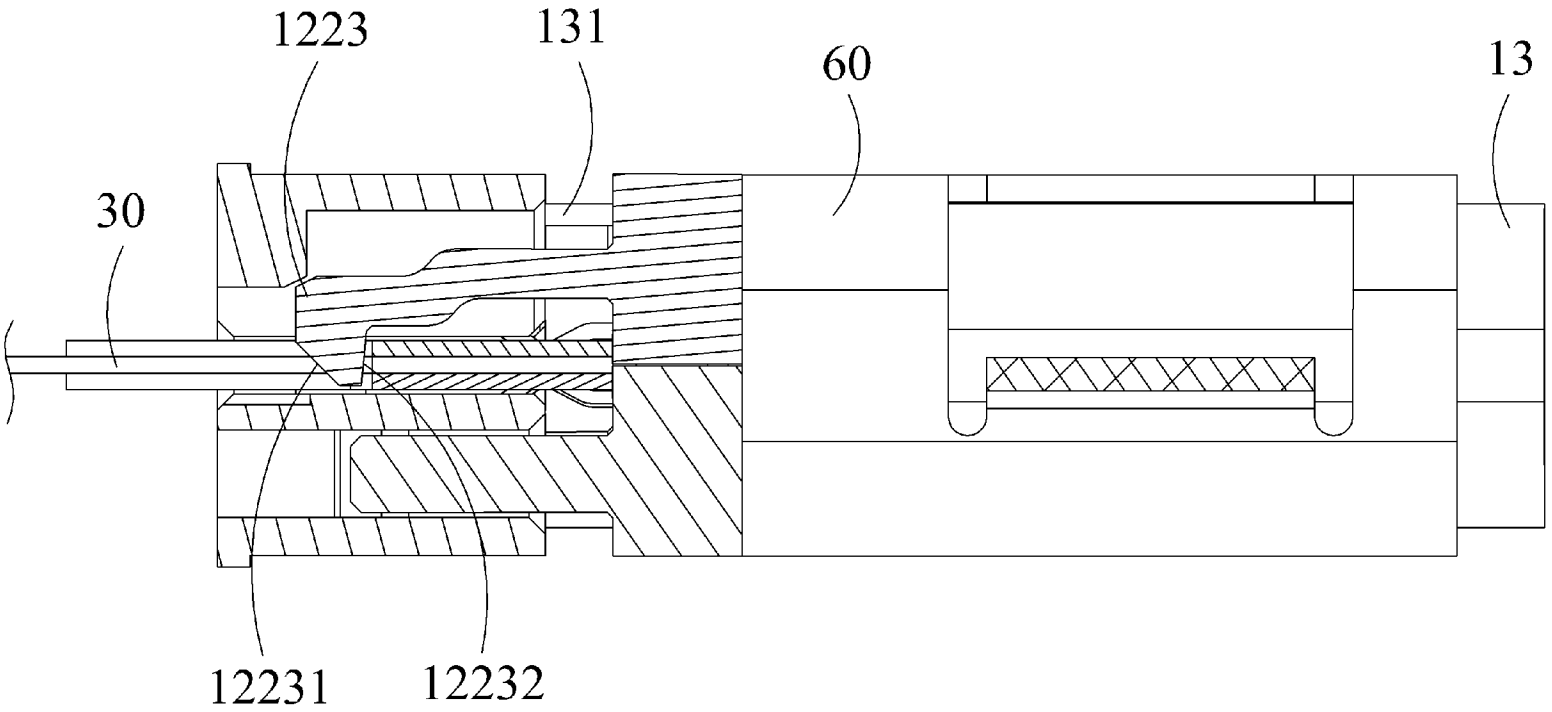
FIG. 3 is a sectional view of a cable unit of a connector expansion structure of the present invention.

Please refer to FIG. 3, which shows a sectional view of a cable unit of a connector expansion structure of the present invention. As shown in FIG. 3, each of the engagement members 1223 includes the sloping engagement structure 12231 and the flat engagement structure 12232 facing the normal direction of the second end surface. When the cable unit 30 is inserted into the engagement members 1223, the cable unit 30 is abutted against the sloping engagement structures 12231 first. The engagement members 1223 are made by elastic plastic, so the sloping engagement structures 12231 are applied by a force along the sloped edge thereof, and then deformed in a sloped direction opposite to the sloping engagement structures 12231, so as to produce a space for insertion of the cable unit 30 into the sloping engagement structures 12231. On the other hand, when the cable unit 30 is accommodated in the engagement members 1223 and the cable unit 30 is pulled, the cable unit 30 can be abutted against the flat engagement structures 12232. The flat structure of the flat engagement structures 12232 faces the plane structure, so the engagement members 1223 does not deform even subject to the divided force applied in longitudinal direction.

When the cable unit 30 is not inserted into the engagement members 1223 and the rear plug 20 is pulled close to the extension structure 122 to abut against the front buckling parts 1311, the engagement members 1223 are deformed downwardly when being pushed by the rear plug 20. This causes the engagement members 1223 to abut against the rear plug 20. As a result, the cable unit 30 is blocked from being inserted into the extension structure 122.

The material of the engagement members 1223 can be, not limited to, elastic plastic or other insulative elastic material.

Figure 4:
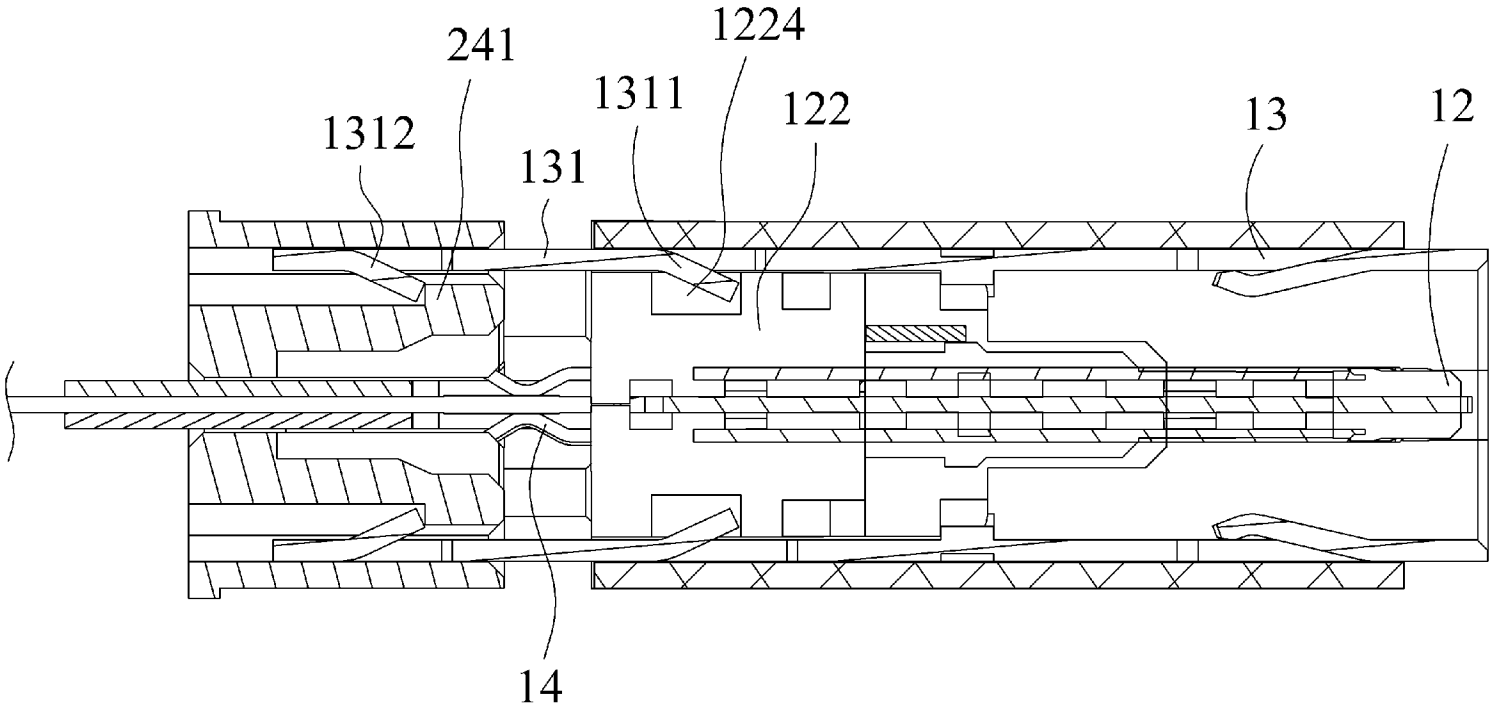
FIG. 4 is a sectional view of a guide plate when a rear plug of a connector expansion structure is moved in the normal direction of the second end surface, according to the present invention.

Please refer to FIG. 4, which shows a sectional view of a guide plate when a rear plug of a connector expansion structure is moved in the normal direction of the second end surface, according to the present invention. As shown in FIG. 4, the rear plug 20 includes a metal buckling parts 241 protruded on the guide plate tracks 24. When the rear plug 20 is pulled backwardly, since the front buckling parts 1311 of the shell-shaped members 13 is fixed in the recessed fastening parts 1224 of the extension structure 122. In this way, when the metal buckling parts 241 is moved backwardly along with the rear plug 20, the metal buckling parts 241 is abutted against the rear buckling part 1312 to be blocked. As shown in FIG. 4, the rear plug 20 can be slidable between the position where the front edge thereof contacts the extension structure 122 and the position where the metal buckling parts 241 abuts against the rear buckling parts 1312.

Figure 5:
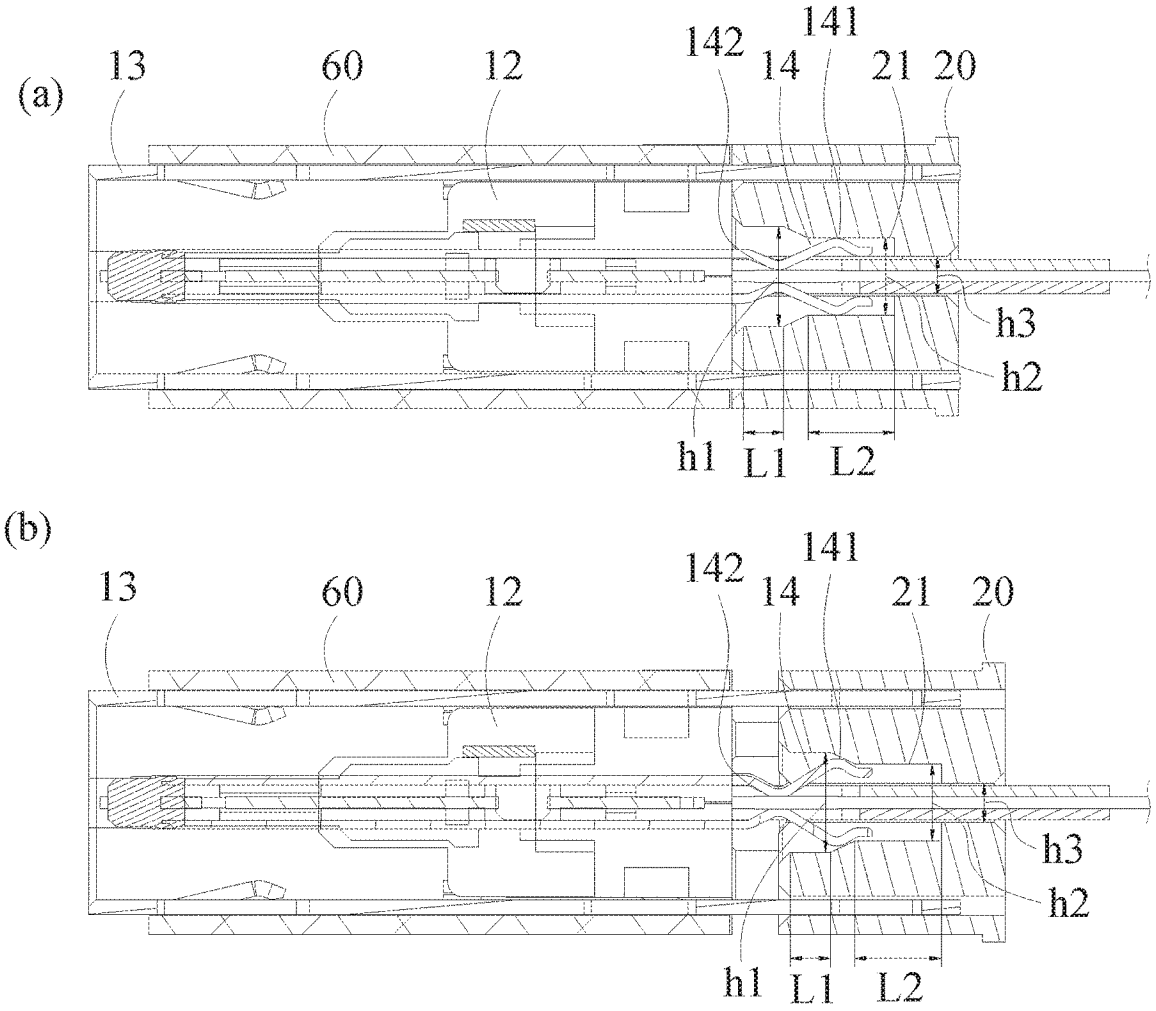
FIG. 5 is a comparison view of cross-section of the conductive terminal track when the rear plug of the connector expansion structure is moved in the normal direction of the second end surface, according to the present invention.

Please refer to FIG. 5, which shows a comparison view of cross-section of the conductive terminal track when the rear plug of the connector expansion structure is moved in the normal direction of the second end surface, according to the present invention. As shown in FIG. 5, each of the conductive terminals 14 includes a clamped parts 141 protruded thereon and having an arc and horny-like shape. Each of the conductive terminal tracks 21 has a ramp space with a gradually-narrowed width and is disposed on a part of the rear plug 20 near to an end of the extension structure 122. The conductive terminal tracks 21 includes a first opening having a height h1 and a first predetermined length L1, a sloped portion with a second predetermined length L2 and a height gradually decreased to a second opening height h2, and a portion extended from the sloped portion by a right angle and having a third opening height h3.

Please refer to part (a) of FIG. 5, when the rear plug 20 is abutted against the extension structure 122, each of the conductive terminals 14 is accommodated in the portion of the conductive terminal tracks 21 having the second opening height h2. The second opening height h2 is shorter than the distance between the top point of the protruding horny part of the clamped parts 141 of the conductive terminals 14, so each of the conductive terminals 14 is longitudinally clamped by the clamping force applied by each of the conductive terminal tracks 21.

The conductive terminals 14 can be made by elastic metal material, and the conductive terminals 14 may be deformed when being applied clamping force in the conductive terminal tracks 21.

Please refer to part (b) of FIG. 5, when the rear plug 20 is pulled out of the extension structure 122, each of the conductive terminals 14 is accommodated in the portion of each of the conductive terminal tracks 21 having the first opening height h1. The first opening height h1 is longer than the distance between the top point of the protruding horny part of each of the clamped parts 141 of each of the conductive terminals 14, so each of the clamped parts 141 of each of the conductive terminals 14 is not applied with clamping force by the conductive terminal tracks 21.

Since each of the clamped parts 141 of the conductive terminals 14 has an arc, bent and protruding shape, the clamping force applied on the conductive terminals 14 are gradually increased along the gradual-decreasing of the opening height of the conductive terminal tracks 21 during the process of pulling the conductive terminals 14 out of the extension structure 122.

The relationship between the first predetermined length L1, the second predetermined length L2, the first opening height h1, the second opening height h2, and the third opening height h3 of the conductive terminal tracks 21 can be adjusted upon the application condition. For example, under the condition that the sliding distance where the rear plug 20 does not apply clamping force on the conductive terminals 14 when the rear plug 20 is pulled out of the sheet-shaped contact part 12 must be extended, the first predetermined length L1 can be increased. Otherwise, the first predetermined length L1 can be decreased. For example, under a condition that the sliding distance where the rear plug 20 applies the clamping force on the conductive terminals 14 when the rear plug 20 is pulled out of the sheet-shaped contact part 12 must be extended, the second predetermined length L2 can be increased. In the other case, the second predetermined length L2 can be decreased.

Figure 6:
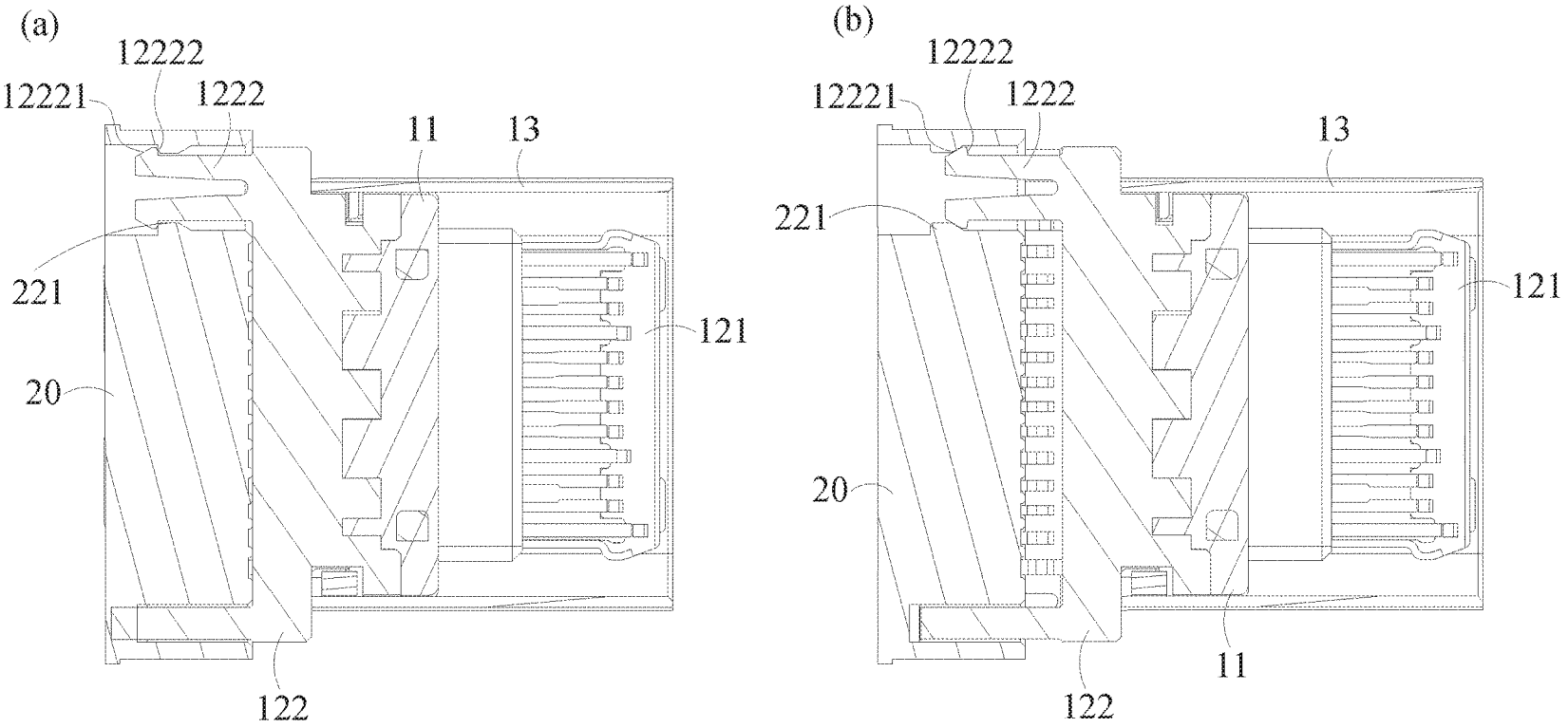
FIG. 6 is a comparison view of cross-section of the position-limit track when the rear plug of the connector expansion structure is moved in the normal direction of the second end surface, according to the present invention.

Please refer to FIG. 6, which shows a comparison view of cross-section of the position-limit track when the rear plug of the connector expansion structure is moved in the normal direction of the second end surface, according to the present invention. As shown in part (b) of FIG. 6, during the process of moving the rear plug 20 to the extension structure 122, the position-limiting members 1222 can be applied with a deformation force through the sloping position-limiting structures 12221 by the protruding part of the position-limit tracks 221 of the rear plug 20. In this way, each of the position-limiting members 1222 is pinched subjected to an applied force, and the rear plug 20 can be moved closer to the extension structure 122. As shown in part (a) of FIG. 6, when the rear plug 20 is moved along the extension structure 122, to abut against the extension structure 122, the flat position-limiting structures 12222 can be abutted against the protruding part of the position-limit tracks 221. This fastens the position-limiting member 1222 and the rear plug 20, thereby increasing the stability of the position-limiting member 1222 fixed in the rear plug 20.

Figure 7:
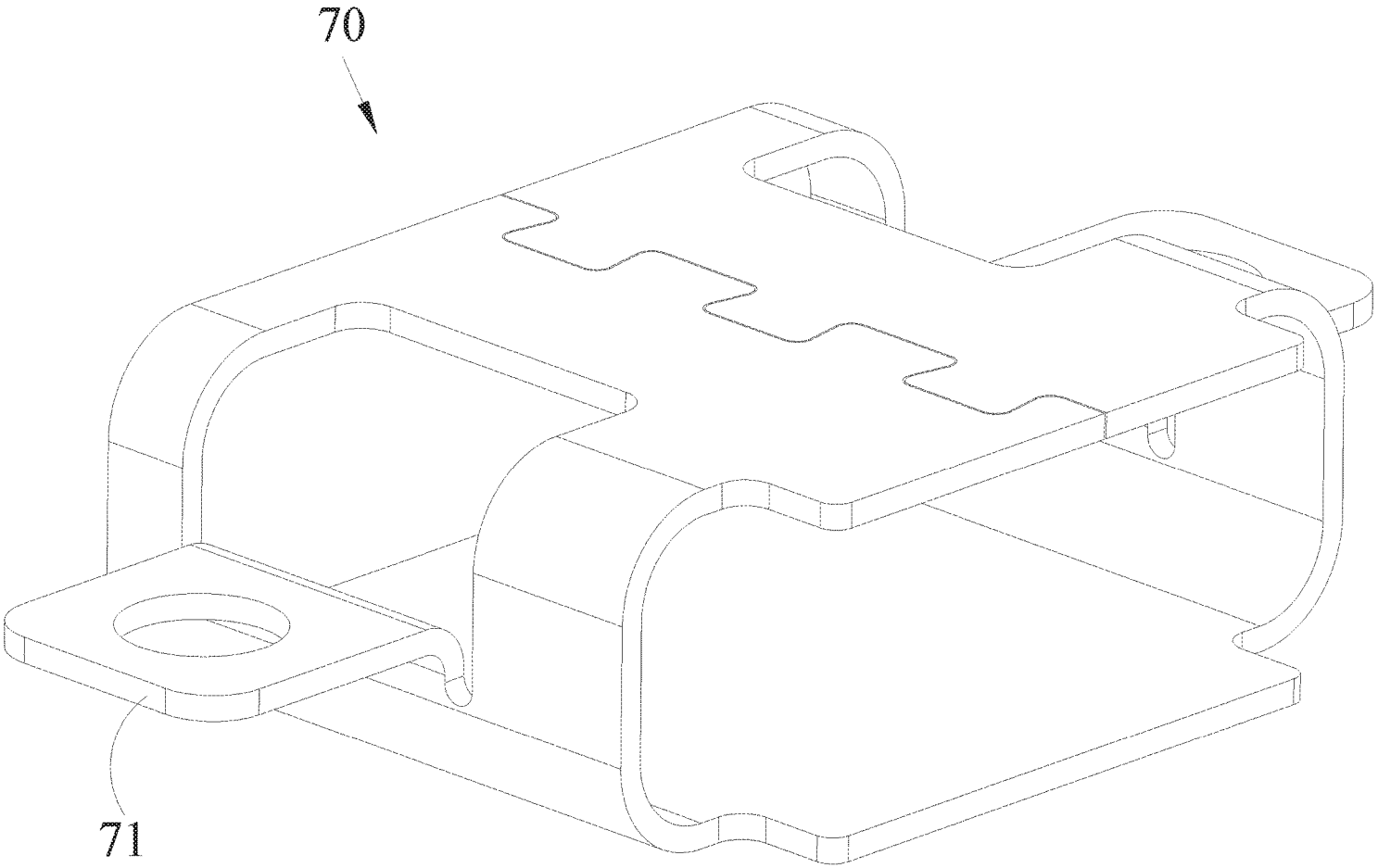
FIG. 7 is a schematic view of a fastening structure of a connector expansion structure of the present invention.

Please refer to FIG. 7, which shows a schematic view of a fastening structure of a connector expansion structure of the present invention. As shown in FIG. 7, the fastening structure is a shell-shaped structure enclosing the connector 10, and includes fastening parts 71 disposed on two sides thereof, and each fastening part 71 includes a hole. FIG. 7 shows an embodiment of a fastening structure of a connector expansion structure of the present invention, and the present invention is not limited thereto. Upon usage requirement, a user can dispose a shell structure partially or fully covering the connector.

Figure 8:
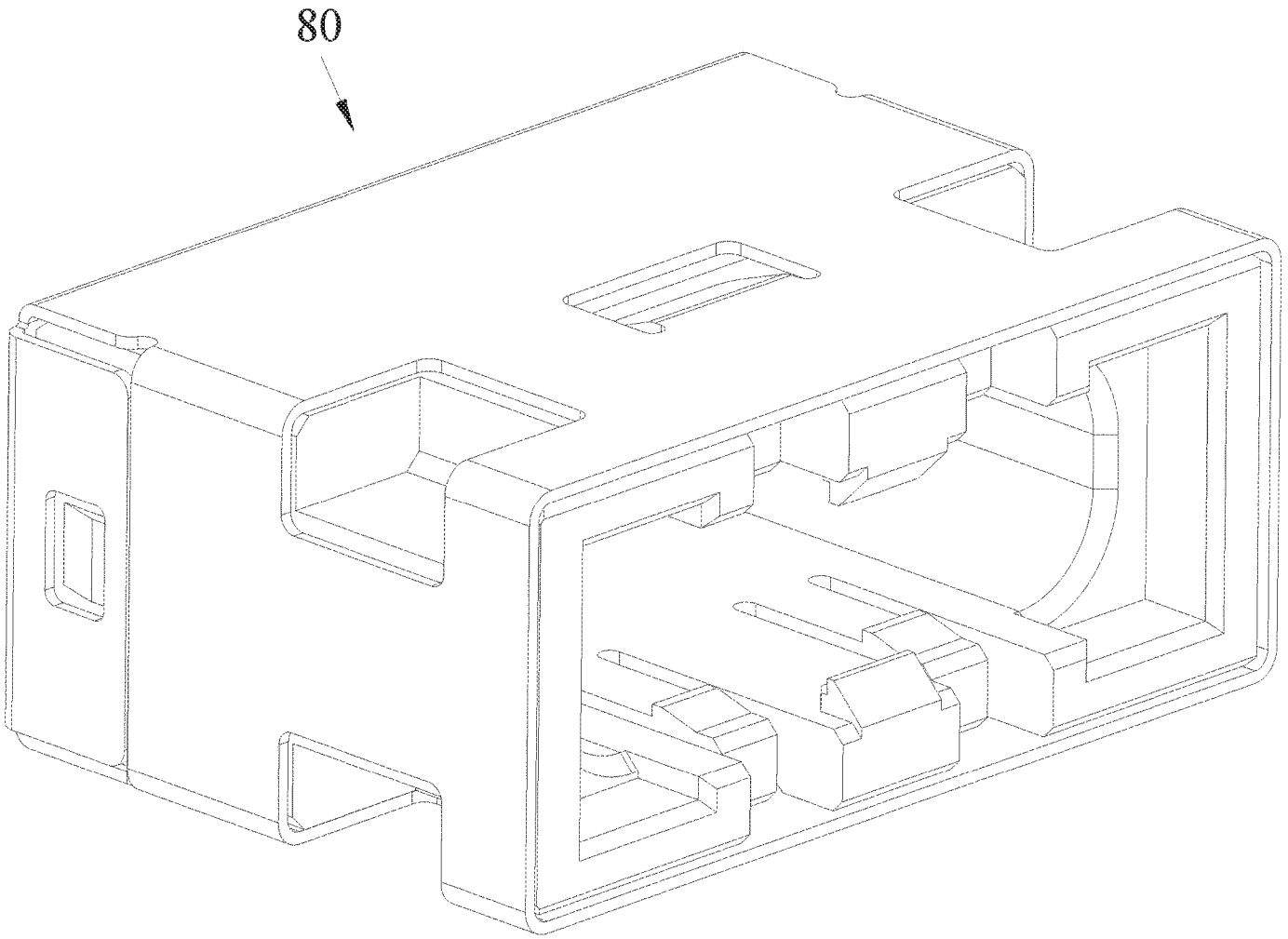
FIG. 8 is a schematic view of a position-limiting block of a connector expansion structure of the present invention.

Please refer to FIG. 8, which shows a schematic view of a position-limiting block of a connector expansion structure of the present invention. As shown in FIG. 8, a position-limiting block 80 is a block-shaped structure configured to accommodate the connector. The position-limiting block 80 defines an accommodation space with a preset height to stably accommodate the connector. The size of the position-limiting block 70 and a recessed groove on the position-limiting block 80 can be adjusted upon application condition.

In conclusion, the positions of the rear plug of the connector expansion structure of the present invention can be adjusted to modify the tightness of contact between the cable structure and the conductive terminals. The user can adjust location of the rear plug upon demand; furthermore, the conductive terminal and the conductive terminal track can increase connection stability of the inserted cable structure.

On the other hand, in the connector expansion structure of the present invention, the fixed members and position-limiting members of the connector can be adjusted according to application condition, thereby increasing the applicability of the connector.

Besides, the guide plate of the connector expansion structure of the present invention can guide the rear plug and shield the high frequency signal of the rear plug, so as to improve quality of signal transmission.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A connector expansion structure, comprising:

a connector comprising:

a base comprising a first end surface and a second end surface;

a sheet-shaped contact part disposed through the base and comprising a sheet-shaped structure extending in a normal direction of the first end surface, and an extension structure extending in a normal direction of the second end surface, wherein the extension structure comprises an extension opening, a plurality of recessed fastening parts disposed on an outer edge of the extension structure, engagement members disposed on two sides of the extension opening and extending in the normal direction of the second end surface and having a bent step structure, and position-limiting members extending in the normal direction of the second end surface;

a shell-shaped member in a ring-shaped structure enclosing the base, and extending in the normal direction of the first end surface to cover the sheet-shaped structure, wherein the shell-shaped member comprises a plurality of guide plates extending in the normal direction of the second end surface; and a plurality of conductive terminals disposed on the sheet-shaped contact part, and extending in the normal direction of the first end surface along the sheet-shaped structure and through the base, and inserted through the extension opening in the normal direction of the second end surface; and a rear plug disposed on the extension structure, and comprising a plurality of conductive terminal tracks configured to accommodate the plurality of conductive terminals, and a plurality of position-limit tracks corresponding to the position-limiting members, a plurality of engagement tracks corresponding to the engagement members, and a plurality of guide plate tracks corresponding to the guide plates are disposed on two sides of the rear plug; wherein the rear plug is slidable on the extension structure.

2. The connector expansion structure according to claim 1, wherein the position-limiting members and the engagement members are disposed on two sides of the extension structure with the same configurations.

3. The connector expansion structure according to claim 1, wherein the position-limiting members and the engagement members are disposed on the two sides of the extension structure with opposite configurations.

4. The connector expansion structure according to claim 1, wherein each of the engagement members comprises a sloping engagement structure facing the normal direction of the second end surface, and a flat engagement structure facing the normal direction of the first end surface, and a cable unit is inserted into the engagement members along the sloping engagement structures, and abutted against the flat engagement structures.

5. The connector expansion structure according to claim 1, wherein each of the position-limiting members has two bar-shaped structures arranged side-by-side, and the two bar-shaped structures comprise sloping position-limiting structures facing the normal direction of the second end surface, and flat position-limiting structures facing the normal direction of the first end surface, and the position-limiting members are inserted into the position-limit tracks along the sloping position-limiting structures and abutted against the flat position-limiting structures.

6. The connector expansion structure according to claim 1, wherein the rear plug is supported by and abutted against the position-limiting members and is slidable on the extension structure.

7. The connector expansion structure according to claim 1, wherein the conductive terminal comprises a clamped part in an arc and bent sharp, and when the rear plug is moved in the normal direction of the first end surface, the conductive terminal tracks applies a clamping force on the conductive terminals through the clamped parts.

8. The connector expansion structure according to claim 1, further comprising a fastening structure enclosing the connector, wherein the fastening structure comprises fastening parts disposed on two sides thereof, respectively, and each of the fastening parts comprises a hole.

9. The connector expansion structure according to claim 1, further comprising a position-limiting block enclosing the connector and configured to fix the connector expansion structure on a transmission interface.

10. The connector expansion structure according to claim 1, wherein each of the plurality of guide plates comprises a front buckling part and a rear buckling part protruded relative to a horizontal direction thereof, and the front buckling parts are configured to fasten with the recessed fastening parts.

11. The connector expansion structure according to claim 10, wherein the rear plug is slidable between the rear buckling part and the extension structure.

12. The connector expansion structure according to claim 10, wherein each of the guide plate tracks comprises a metal buckling part, and the metal buckling parts are configured to fasten with the recessed fastening parts.

13. The connector expansion structure according to claim 10, wherein when a cable unit is not inserted into the connector expansion structure but the rear plug is slid to abut against the front buckling parts, the engagement members are clamped by the plurality of engagement tracks to contact the rear plug, so as to block the cable unit from being inserted into the connector expansion structure.

* * * * *